US012520908B2

(12) United States Patent
Uzzeni

(10) Patent No.: US 12,520,908 B2
(45) Date of Patent: Jan. 13, 2026

(54) PROFESSIONAL WORK SHOE WITH REINFORCED HEEL AND RELATED MANUFACTURING PROCESS

(71) Applicant: U-POWER GROUP S.P.A., Paruzzaro (IT)

(72) Inventor: Pier Franco Uzzeni, Dagnente (IT)

(73) Assignee: U-POWER GROUP S.P.A., Paruzaro (IT)

( * ) Notice: Subject to any disclaimer, the term of this patent is extended or adjusted under 35 U.S.C. 154(b) by 0 days.

(21) Appl. No.: 18/275,954

(22) PCT Filed: Feb. 21, 2022

(86) PCT No.: PCT/IB2022/051507
§ 371 (c)(1),
(2) Date: Aug. 4, 2023

(87) PCT Pub. No.: WO2022/180501
PCT Pub. Date: Sep. 1, 2022

(65) Prior Publication Data

US 2024/0099426 A1 Mar. 28, 2024

(30) Foreign Application Priority Data

Feb. 23, 2021 (IT) ..... 102021000004202

(51) Int. Cl.
*A43B 23/17* (2006.01)
*A43B 7/08* (2022.01)
*A43B 23/02* (2006.01)

(52) U.S. Cl.
CPC ..... *A43B 23/17* (2013.01); *A43B 7/084* (2013.01); *A43B 23/022* (2013.01)

(58) Field of Classification Search
CPC ..... A43B 23/08; A43B 23/088; A43B 23/16; A43B 23/17; A43B 23/022; A43B 7/08; A43B 7/084; A43B 7/085; A43B 7/32
See application file for complete search history.

(56) References Cited

U.S. PATENT DOCUMENTS 4,222,183 A * 9/1980 Haddox ..... A43B 7/06 36/114
4,704,808 A * 11/1987 Bianchini ..... A43B 9/00 36/43
5,604,998 A * 2/1997 Kita ..... A43B 23/17 36/71

(Continued)

FOREIGN PATENT DOCUMENTS

EP 2724635 A1 4/2014
WO 9417685 A1 8/1994
WO 2016142897 A1 9/2016

*Primary Examiner* — Aiying Zhao
(74) *Attorney, Agent, or Firm* — Dickinson Wright PLLC; Andrew D. Dorisio

(57) ABSTRACT

A professional work shoe with a reinforced heel includes an upper and a layered sole associated with the upper. The reinforced heel is made of a thermoplastic polymer associated respectively with the upper and with the layered sole, having a plurality of through openings, and at least one waterproof and breathable membrane fixed to the reinforced heel at least in correspondence with the through openings. The professional work shoe further includes an inner lining adapted to cover at least the inner surface of the reinforced heel.

11 Claims, 4 Drawing Sheets

(56) References Cited

U.S. PATENT DOCUMENTS

| | | | | |
|---|---|---|---|---|
| 6,401,364 | B1 * | 6/2002 | Burt | A43B 1/00 36/3 R |
| 2006/0117608 | A1 * | 6/2006 | Chen | A43B 7/085 36/58.6 |
| 2007/0068043 | A1 * | 3/2007 | Clark | A43B 7/125 36/73 |
| 2011/0119959 | A1 * | 5/2011 | Bodner | A43B 15/00 36/78 |
| 2016/0000176 | A1 * | 1/2016 | Peikert | A43B 7/08 36/3 A |
| 2017/0099909 | A1 * | 4/2017 | Lee | A43B 23/07 |
| 2020/0068991 | A1 * | 3/2020 | Steere, Jr. | A43B 3/24 |

* cited by examiner

PROFESSIONAL WORK SHOE WITH REINFORCED HEEL AND RELATED MANUFACTURING PROCESS

Technical Field

The present invention relates to a professional work shoe with a reinforced heel, as well as a process for manufacturing the same.

Background

Professional work shoes are known in the art which are able to offer the user a desired degree of protection should accidental events occur.

As is known, professional work shoes are to comply with stringent standards, included among which are:

- EN ISO 20345, relative to safety footwear with shoe toe resistance at 200 J;
- EN ISO 20346, relative to safety footwear with shoe toe resistance at 100 J;
- EN ISO 20344, relative to testing methods and general requirements;
- EN ISO 20347, relating to work or professional footwear without any specific toe cap resistance.

In particular, in order to be defined as safety or accident-prevention shoes, work shoes are to be provided with a safety toe cap and therefore comply with Standards EN ISO 20344, EN ISO 20345 and EN ISO 20346.

Safety shoes therefore comprise an upper assembly provided, at the shoe toe, with a safety toe cap that is sufficiently structured, and therefore rigid, to resist knocks or crushing, thus protecting the user's foot.

In general, since work footwear is involved, it is intended to be worn by the user continuously for several hours a day, under the most varied working conditions.

Safety shoes are frequently worn by operators working on construction sites of various types, very often outdoors, and therefore in conditions subject to bad weather, rough terrain or uneven surfaces that tend to wear the shoes themselves and/or damage the uppers.

The use of stronger and stiffer materials for at least some of the components of safety shoes can increase the durability of the shoes, but at the expense of the level of comfort perceived by the user, as well as the manufacturing costs.

Summary

The main task of the present invention is therefore to create a professional work shoe with a reinforced heel that is able to guarantee, at the same time, greater durability, a high level of comfort and a contained production cost.

In the context of this task, an aim of the present invention is to produce a professional work shoe which meets the requirements of any type of user and which can be worn for an extended period of time without discomfort or inconvenience to the user.

Another aim of the invention is to create a professional work shoe that is also very easy to put on and off.

The task disclosed above, and also the objects mentioned and others which will become more apparent below.

Other features are provided in the dependent claims.

BRIEF DESCRIPTION OF THE DRAWINGS

Further features and advantages shall be more apparent from the description of a preferred, but not exclusive, embodiment of a professional work shoe, illustrated merely by way of non-limiting example with the aid of the accompanying drawings, in which.

DETAILED DESCRIPTION

Figure 1:
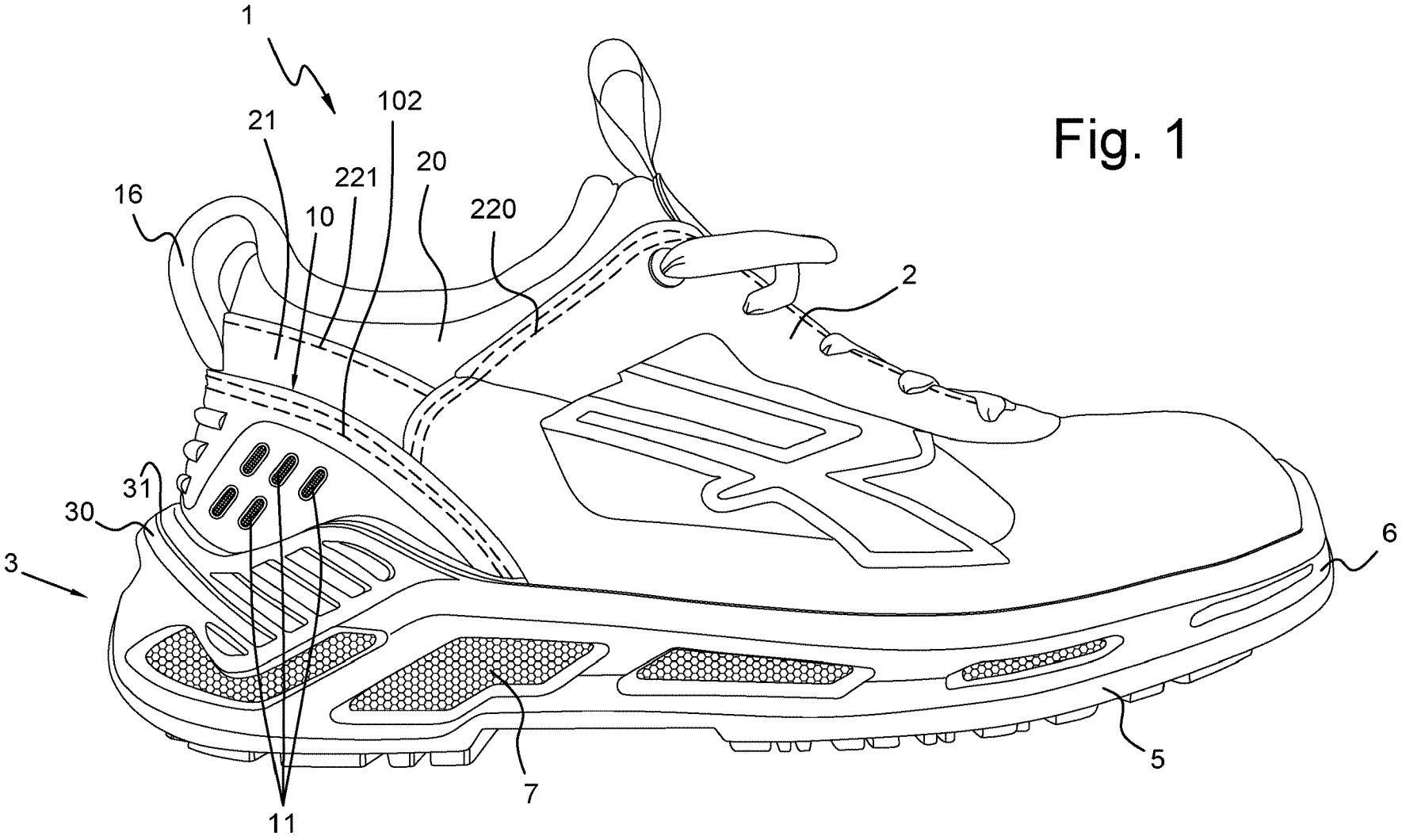
FIG. 1 is a raised side view of an embodiment of a professional work shoe with a reinforced heel, according to the invention.
Figure 2:
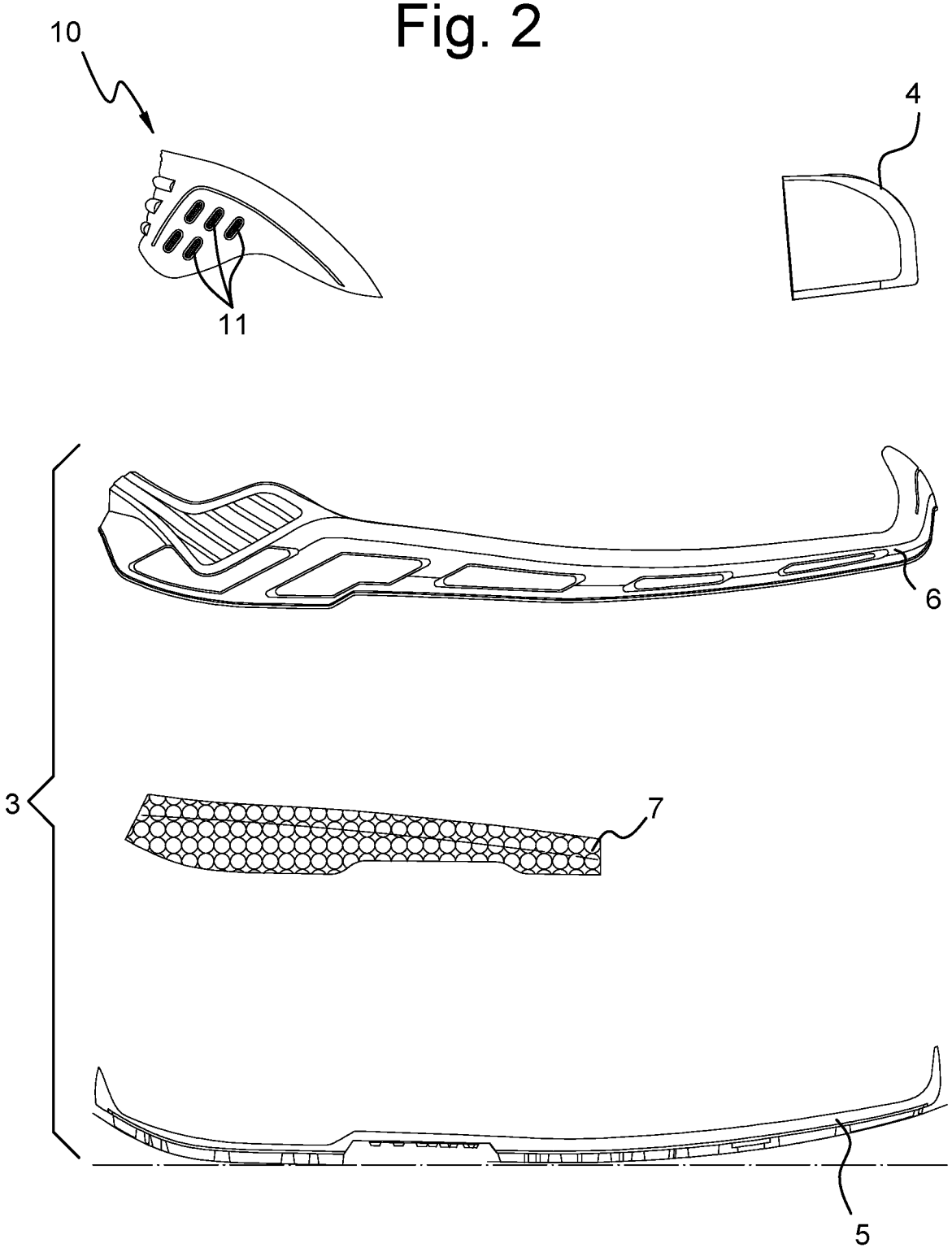
FIG. 2 is an exploded side view of some components of the shoe in FIG. 1.

With reference to the above figures, the professional work shoe with a reinforced heel, generally indicated with the reference number 1, comprises an upper 2 and a layered sole 3 associated with the upper 2.

According to the invention, the professional work shoe 1 comprises a reinforced heel 10, also known by the term "heel counter", made of a thermoplastic polymer, associated with the upper 2 and the layered sole 3 respectively. This reinforced heel 10 further comprises a plurality of through openings 11. At least one waterproof and breathable membrane 12 fixed to the reinforced heel 10 itself is provided at such through openings 11. The shoe 1 further comprises an inner lining 13 adapted to cover at least the inner surface of the reinforced heel 10.

Advantageously, the shoe 1 further comprises a spongy insert 19 internally associated with the reinforced heel 10, wherein the inner lining 13 is adapted to cover at least the inner surface of the reinforced heel 10 and of the spongy insert 19.

Advantageously, the spongy insert 19 extends over a portion of the inner surface of the reinforced heel 10 in such a way as to fully cover the waterproof and breathable membrane 12, or in such a way as not to cover it at all, or again in such a way as to cover it only partially.

Advantageously, the inner lining 13 thus also covers the spongy insert 19 and the at least one waterproof and breathable membrane 12.

The presence of the reinforced heel 10 made of a thermoplastic polymeric material gives the shoe 1 a more rigid and containing structure of the user's foot, as it increases and improves the support and hold of the user's heel, compared for example with heels made of leather or fabric. However, the presence of the through openings 11, with waterproof and breathable membrane 12, allows the correct transpiration of the foot, thus obtaining overall an increased level of comfort both as regards the adherence of the shoe 1 to the foot, in particular during the most dynamic activities, and as regards the regulation of the temperature and humidity inside the shoe 1.

Furthermore, the contact of the user's foot with the reinforced heel 10 is cushioned and made comfortable by the presence of the spongy insert 19, which has a padding function.

Figure 3:
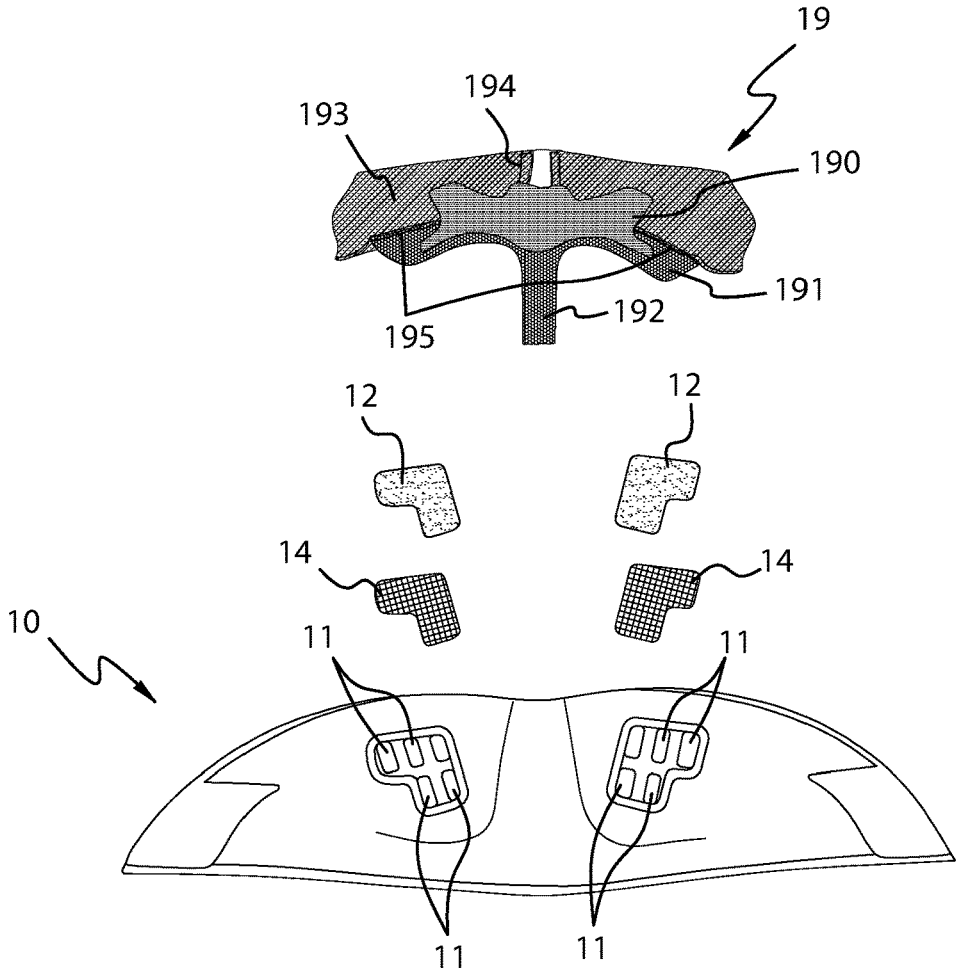
FIG. 3 shows, in an exploded view, the inner face of the reinforced heel of the shoe in FIG. 1.
Figure 4:
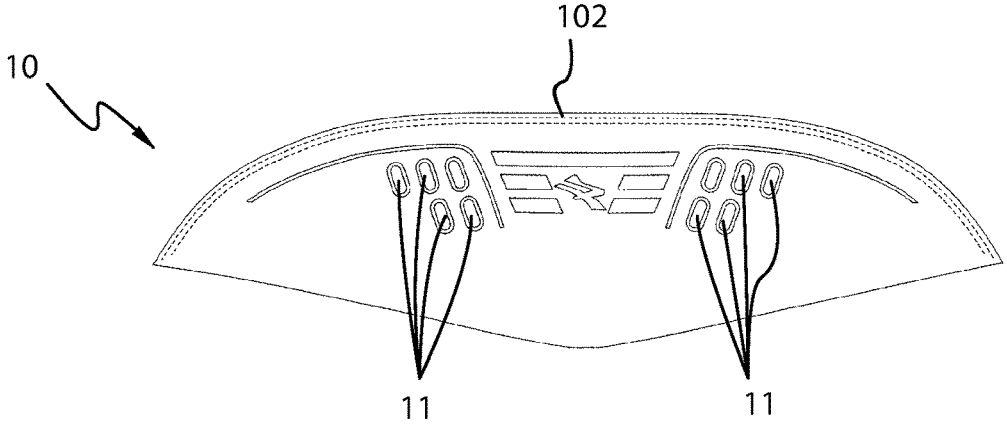
FIG. 4 illustrates the outer face of the reinforced heel of the shoe in FIG. 1.

As illustrated in the exploded view in FIG. 3, the at least one waterproof and breathable membrane 12 is advantageously fixed to the inner face of the reinforced heel 10.

Advantageously, the waterproof and breathable membrane 12 may be co-molded to the reinforced heel 10, so that the perimeter edges thereof are embedded in the material of which the reinforced heel 10 is made, while the central area remains exposed.

Advantageously, the reinforced heel 10 is made of a thermoplastic elastomer, and preferably a thermoplastic polyurethane (TPU).

Advantageously, the waterproof and breathable membrane can be made of a material such as polytetrafluoroethylene (PTFE).

Figure 5:
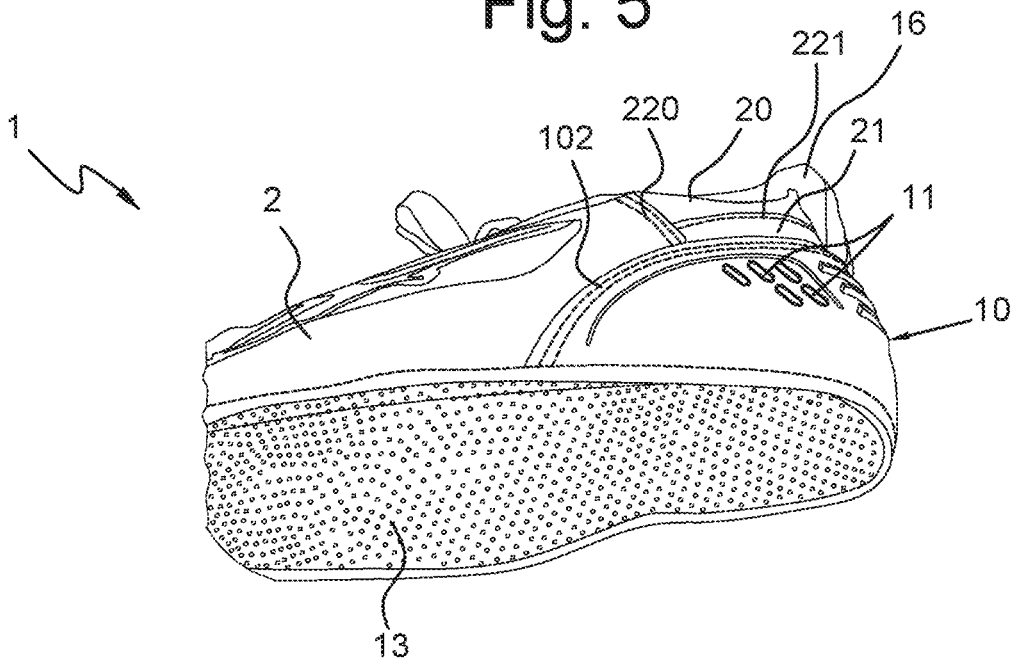
FIG. 5 is a perspective view, from below, of the upper and reinforced heel of the shoe of FIG. 1, mutually associated, within which the inner lining of the shoe is visible.

Advantageously, as illustrated in FIG. 5, the inner lining 13 is adapted to cover both the inner surface of the reinforced heel 10 (possibly including the spongy insert 19) and the inner surface of the upper 2 continuously.

Advantageously, as illustrated in particular in FIG. 3, between the reinforced heel 10 and the waterproof and breathable membrane 12, at least in correspondence with the through openings 11 present in the reinforced heel 10, there is a net 14 for the protection of the waterproof and breathable membrane 12. Such net 14 advantageously allows dirt to be kept outside the through openings 11.

As illustrated in the figures, the net 14 is visible from the outside the shoe 1, through the openings 11 in the reinforced heel 10.

Advantageously, the net 14 is also co-molded to the reinforced heel 10 together with the waterproof and breathable membrane 12.

Advantageously, the spongy insert 19 comprises at least one spongy element 190 made of foam rubber, for example expanded elastic polyurethane.

The spongy insert 19 is placed at the back of the user's foot which is most likely to come into contact and rub against the reinforced heel 10 during walking. The spongy element 190 is in turn placed at the rear and substantially upper part of the heel, as well as the tendon, of the user where the contact and rubbing between the reinforced heel 10 and the user's foot is further more critical and delicate.

Advantageously, the spongy insert 19 also comprises a highly breathable layer 191, made, for example, of perforated fabric, or possibly non-woven fabric. This highly breathable layer 191 promotes ventilation of the foot. As illustrated in FIG. 3, such a highly breathable layer 191 advantageously comprises a longitudinally extending central portion 192.

The spongy insert 19 advantageously further comprises an additional foam rubber layer 193, for example made of polyester-based flexible polyurethane foam, which is thinner than the spongy element 190 but with a larger extension.

As illustrated in FIG. 3, the foam rubber layer 193 may comprise two separate ones joined centrally by a connecting element, by means of a seam 194. In addition, the highly breathable layer 191 and the foam rubber layer 193 may also be mutually sewn together along corresponding edges, along the seam line 195.

Advantageously, the layered sole 3 comprises a portion 30 projecting to the rear of the reinforced heel 10. Said protruding portion 30 has an upper surface 31 configured to allow the user to step out of one shoe 1 by placing the toe of the other shoe, or other foot, thereon and extracting the foot. The presence of this protruding portion 30 therefore prevents damage to the rear part of the shoe 1 in the case of users accustomed to taking off the shoe with the opposite foot, rather than with their hands.

Advantageously, the reinforced heel 10 is stitched to the upper 2 along the upper perimeter edge thereof. The seam line between the reinforced heel 10 and the upper 2 is indicated by the number 102.

Advantageously, the seam 102 is also adapted to simultaneously sew the spongy insert 19 to the reinforced heel 10 and to the upper 2.

The upper 2, which is made of fabric, non-woven fabric or leather, or a combination of two or more of such materials, does not include the heel portion, which consists exclusively of the reinforced heel 10 made of a thermoplastic polymer, with the relevant components. In other words, the reinforced heel 10 is not superimposed, in correspondence with the heel of the user, on the upper 2, but replaces, in that area, the upper 2 itself.

Figure 6:
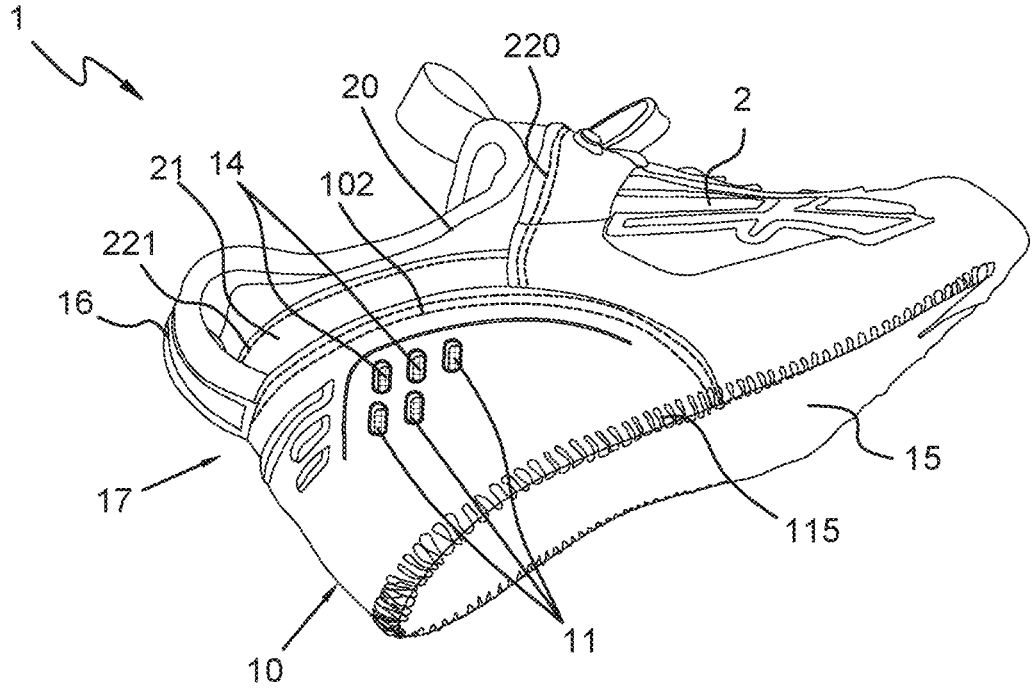
FIG. 6 is a perspective view, from below, of the upper and reinforced heel of the shoe in FIG. 1, to which components an insole of the shoe itself is sewn.

Advantageously, as illustrated in particular in FIG. 6, the shoe 1 comprises an insole 15. The upper 2 and the reinforced heel 10 are both sewn along their respective lower perimeter edges to the perimeter edge of the insole 15. The seam line of the insole 15 to the upper 2 and reinforced heel 10 is shown in FIG. 6 with number 115.

Advantageously, the seam 115 of the insole 15 with upper 2 and reinforced heel 10 is a strobel-type seam.

Advantageously, the insole 15 can be a puncture-resistant insole, such as a non-metallic insole made of puncture-resistant fabric.

Advantageously, the upper 2 comprises, at the user's ankle, a collar 20.

Advantageously, the shoe 1 comprises a strip of fabric 16 sewn at its ends respectively to the upper edge of the collar 20 and to the upper edge of the reinforced heel 10, wherein such strip of fabric 16 is adapted to be grasped by the user, in a loop manner, to facilitate the fitting of the shoe 1.

Advantageously, the collar 20 is made of a fabric comprising elastic technofibers, preferably a spandex fabric, and is configured, in use, to elastically adhere to the user's ankle, so as to assume a so-called "sock-like" configuration. In this way, the rigidity conferred by the reinforced heel 10 at the user's heel is compensated for by the elastic structure of the collar 20, which adheres perfectly and elastically to the user's ankle.

Advantageously, the collar 20 is configured to increase the hold of the foot inside the shoe 1 while also ensuring high wearing comfort.

As illustrated in particular in FIG. 1, the collar 20, made in the form of a sock, is sewn to the remaining part of the upper 2 along the seam line indicated by 220.

Advantageously, the upper 2 also has a reinforcing band 21 made of fabric, or non-woven fabric, or leather, associated with both the collar 20 made of elastic technofibers and the reinforced heel 10, and intended to reinforce precisely the joining area between the reinforced heel 10 and the collar 20. Reference number 221 indicates the seam line of the reinforcement band 21 to the collar 20. This band 21, being less rigid than the reinforced heel 10 but more rigid than the collar 20, promotes the connection between these two components of the shoe 1, preventing possible lacerations of the collar 20 following excessive traction acting on the collar 20 itself.

Advantageously, through openings 11 are provided on both sides of the reinforced heel 10.

Advantageously, the total surface area of the through openings 11 is comprised between 100 and 300 $mm^2$, and also depends in part on the size of the shoe 1.

In an embodiment not shown, the reinforced heel 10 may have a pair of through openings on either side of it, each having a surface area comprised between 50 and 150 $mm^2$.

Preferably the reinforced heel 10 has a total number of through openings greater than or equal to four, preferably greater than or equal to eight.

As shown in the accompanying figures, there may be five through openings per side, each having a surface area comprised between 10 and 30 $mm^2$, and preferably comprised between 13 and 21 $mm^2$.

Furthermore, the through openings 11 may be made, on each side, in close proximity to each other, so that a single waterproof and breathable membrane 12, and a single net 14, may be applied to each group of contiguous through openings 11.

Advantageously, the upper 2 is provided, at the shoe toe, with a safety toe cap 4.

The presence of a safety toe cap 4, in compliance with the standard EN ISO 20345, i.e. with a resistance of 200 J, makes the professional work shoe a so-called "safety" work shoe.

The presence of a safety toe cap 4, in compliance with the standard EN ISO 20346, i.e. with a resistance of 100 J, makes the professional work shoe a so-called "protective" work shoe.

In the absence of safety toe cap 4, the shoe is still a professional work shoe, as it complies with EN ISO 20347.

Although the minimum requirement set out in EN ISO 20345 and EN ISO 20346 for safety shoes is the simple presence of a safety toe cap 4, advantageously the shoe 1 can be fitted with a safety toe cap 4 provided with holes configured to ensure foot breathability, preferably covered by a waterproof membrane, not shown.

Advantageously, the layered sole 3 comprises a first, lower layer 5, i.e., a tread, adapted to come into contact with the ground, and a second, upper layer 6, associated respectively with the upper 2, the reinforced heel 10 and the first layer 5.

Advantageously, below the insole 15 and within the second layer 6 there may be an elastic insert 7, at the rear area of the shoe 1, i.e. substantially at the heel of the user.

Advantageously, the elastic insert 7 has a transverse thickness which is greater at the rear than the transverse thickness at the front.

In particular, the elastic insert 7 has a thickness comprised between 15 and 30 millimetres in the rear area, and a thickness comprised between 8 and 15 millimetres in the front area.

The present invention also relates to a process for manufacturing a professional shoe 1 with a reinforced heel.

According to the invention, such process comprises the steps of:

a) making a reinforced heel 10 from a thermoplastic polymer;

b) making a spongy insert 19 with a padding function;

c) applying the spongy insert 19 to the internal surface of the reinforced heel 10;

d) having an upper 2 without the heel portion;

e) sewing the reinforced heel 10, and at the same time the spongy insert 19, to the upper 2;

f) sewing the perimeter edge of an insole 15 to the lower edge of the reinforced heel 10 and the lower edge of the upper 2 to make an intermediate component 17 of the professional work shoe 1, illustrated in FIG. 6;

g) cc-molding a layered sole 3 to such intermediate component 17.

Advantageously, such step g) of co-molding can be carried out by means of polyurethane injection co-molding.

Advantageously, the process for manufacturing a professional work shoe 1 with a reinforced heel comprises, between said step e) and said step f), the step of associating an inner lining 13 to both the inner surface of the reinforced heel 10 and the inner surface of the upper 2, wherein said inner lining 13 also covers the spongy insert 19.

Advantageously, step a) comprises the step of co-molding a waterproof, breathable membrane 12 to the reinforced heel 10, which reinforced heel 10 comprises a plurality of through openings 11. Such waterproof and breathable membrane 12 is co-molded to the reinforced heel 10 at least in correspondence with the through openings 11.

Advantageously, the reinforced heel 10 is fixed to the spongy insert 19 and the upper 2 in a single sewing operation, along the seam line 102, thereby speeding up the process of manufacturing the professional work shoe 1.

In practice, it was found that the professional work shoe with a reinforced heel, according to the present invention, fulfils the intended task and purpose because it is comfortable to wear and use, both in dynamic and static activities, thanks to the support and hold provided by the reinforced heel, including padding, and at the same time thanks to the excellent breathability characteristics guaranteed by the through openings and the waterproof and breathable membrane.

Another advantage of the professional work shoe, according to the invention, is that it is easy to put on, thanks to the grip loop, and at the same time easy to take off, thanks to the protruding portion that can be engaged with the toe of the foot opposite the one being taken off.

Another advantage of the professional work shoe, according to the invention, is that it fits snugly around the ankle of the foot, thanks to the elastic fabric collar.

Another advantage of the professional work shoe is the increased durability that the presence of the reinforced heel confers to the shoe itself.

Another advantage is the ease with which the shoe itself can be made, and in particular the ease with which the reinforced heel can be made and the various components of the shoe can be assembled, therefore the contained economic impact.

The professional work shoe thus conceived is susceptible to many modifications and variants, all falling within the same inventive concept; furthermore, all details can be replaced by equivalent technical elements. In practice, any materials can be used according to requirements, as long as they are compatible with the specific use, the dimensions and the contingent shapes.

The invention claimed is:

1. A professional work shoe with a reinforced heel, comprising:

an upper;

a layered sole associated with said upper;

a reinforced heel made of a thermoplastic polymer associated respectively with said upper and with said layered sole, said reinforced heel comprising a plurality of through openings, wherein a waterproof and breathable membrane is fixed to said reinforced heel in correspondence with said through openings;

an inner lining adapted to cover a portion of said reinforced heel, wherein said portion comprises an inner surface of said reinforced heel; and a spongy insert internally associated with said reinforced heel, wherein said inner lining is adapted to cover the inner surface of said reinforced heel and an inner surface of said spongy insert;

wherein said spongy insert comprises a first layer made of foam rubber, a second layer made of foam rubber, wherein the second layer has a thickness less than a thickness of the first layer and a length greater than a length of the first laver; and a third layer made of a breathable fabric for ventilation of a foot.

2. The professional work shoe, according to claim 1, wherein said upper is provided, at a toe portion, with a safety toe cap.

3. The professional work shoe, according to claim 1, wherein said reinforced heel is made of a thermoplastic elastomer.

4. The professional work shoe, according to claim 1, wherein said inner lining is adapted to cover both the inner surface of said reinforced heel and an inner surface of said upper.

5. The professional work shoe, according to claim 1, wherein, between said reinforced heel and said waterproof and breathable membrane, in correspondence with said portion of said reinforced heel, wherein said portion comprises said through openings, a net is provided for the protection of said waterproof and breathable membrane.

6. The professional work shoe, according to claim 1, wherein said layered sole comprises a portion projecting rearwardly with respect to said reinforced heel.

7. The professional work shoe, according claim 1, wherein said reinforced heel is sewn to said upper along an upper perimeter edge of said reinforced heel.

8. The professional work shoe, according to claim 1, further including an insole, said reinforced heel and said upper being both sewn, along their respective lower perimeter edges, at a perimeter edge of said insole.

9. The professional work shoe, according to claim 1, wherein said upper comprises a collar configured to be positioned at a user's ankle, said professional work shoe comprising a strip of fabric sewn at its ends respectively to an upper edge of said collar and to an upper edge of said reinforced heel adapted to be grasped by the user to facilitate a fitting of said professional work shoe.

10. The professional work shoe, according to claim 1, wherein said upper comprises a collar configured to be positioned at a user's ankle made of an elastic fabric, configured, in use, to adhere elastically to the user's ankle.

11. The professional work shoe, according to claim 1, wherein said through openings are provided on a first side and a second side of said reinforced heel, the overall surface of said through openings being between 100 and 300 $mm^2$.

* * * * *